US006450843B1

(12) United States Patent
Heimuller

(10) Patent No.: US 6,450,843 B1
(45) Date of Patent: Sep. 17, 2002

(54) ONE-PIECE CONTACT SPRING

(75) Inventor: Hans-Jost Heimuller, Dudenhofen (DE)

(73) Assignee: Siemens Electromechanical Components GmbH & Co. KG (DE)

( * ) Notice: Subject to any disclaimer, the term of this patent is extended or adjusted under 35 U.S.C. 154(b) by 0 days.

(21) Appl. No.: 09/719,918

(22) PCT Filed: Jun. 16, 1999

(86) PCT No.: PCT/DE99/01766

§ 371 (c)(1),
(2), (4) Date: Mar. 22, 2001

(87) PCT Pub. No.: WO99/66600

PCT Pub. Date: Dec. 23, 1999

(30) Foreign Application Priority Data

Jun. 16, 1998 (DE) ..... 198 26 828

(51) Int. Cl.[7] ..... H01R 11/22
(52) U.S. Cl. ..... 439/852; 439/843
(58) Field of Search ..... 439/852, 862, 439/816, 851, 856, 857, 858, 861, 843

(56) References Cited

U.S. PATENT DOCUMENTS

| | | | | |
|---|---|---|---|---|
| 3,713,080 A | | 1/1973 | Kennedy | |
| 3,718,895 A | | 2/1973 | Reynolds et al. | |
| 4,148,547 A | * | 4/1979 | Otsuki et al. | 439/258 R |
| 4,184,736 A | * | 1/1980 | Spaulding | 439/258 R |
| 4,564,259 A | | 1/1986 | Vandame | |
| 4,696,530 A | | 9/1987 | Vandame | |
| 5,186,663 A | * | 2/1993 | Wymetenberg | 439/843 |
| 5,593,328 A | * | 1/1997 | Okada et al. | 439/851 |
| 5,989,078 A | * | 11/1999 | Chailloet et al. | 439/851 |
| 6,059,595 A | * | 5/2000 | Lacrouts-Cazenave | 439/289 |
| 6,152,787 A | * | 11/2000 | Serbin et al. | 439/852 |
| 6,203,385 B1 | * | 3/2001 | Sato et al. | 439/852 |

FOREIGN PATENT DOCUMENTS

| | | |
|---|---|---|
| DE | 22 43 471 | 3/1973 |
| DE | 36 36 466 | 5/1987 |
| DE | 4340377 | 6/1995 |
| EP | 0 152 312 | 5/1985 |
| EP | 650222 | 4/1995 |
| EP | 837529 | 4/1998 |

OTHER PUBLICATIONS

Copy of International Search Report dated Sep. 29, 1999 issued in corresponding PCT Application No. PCT/DE99/01766.

* cited by examiner

*Primary Examiner*—Tho D. Ta
*Assistant Examiner*—Phuongchi Nguyen
(74) *Attorney, Agent, or Firm*—Baker & Daniels

(57) ABSTRACT

The invention relates to a one-piece contact spring (10, 11) including a box-shaped contact part (20) having a bottom wall (22) side walls (24, 26) and a top wall (28), and including a spring arm (32) which is bent back into the interior of the contact part at the insertion opening and together with at least one additional spring arm (34) forms a plug-in contact socket, wherein the spring arm (32) bent back into the interior of the contact part is integrally formed on the narrow side of the bottom wall (22) or a side wall (26) on the face side thereof, that at least two additional spring arms (34) are integrally formed laterally at the free end of the bent-back spring arm (32) and are set on edge at right angles and extend with their free ends towards the insertion opening and constitute a receptacle for a complementary contact.

15 Claims, 4 Drawing Sheets

FIG 7
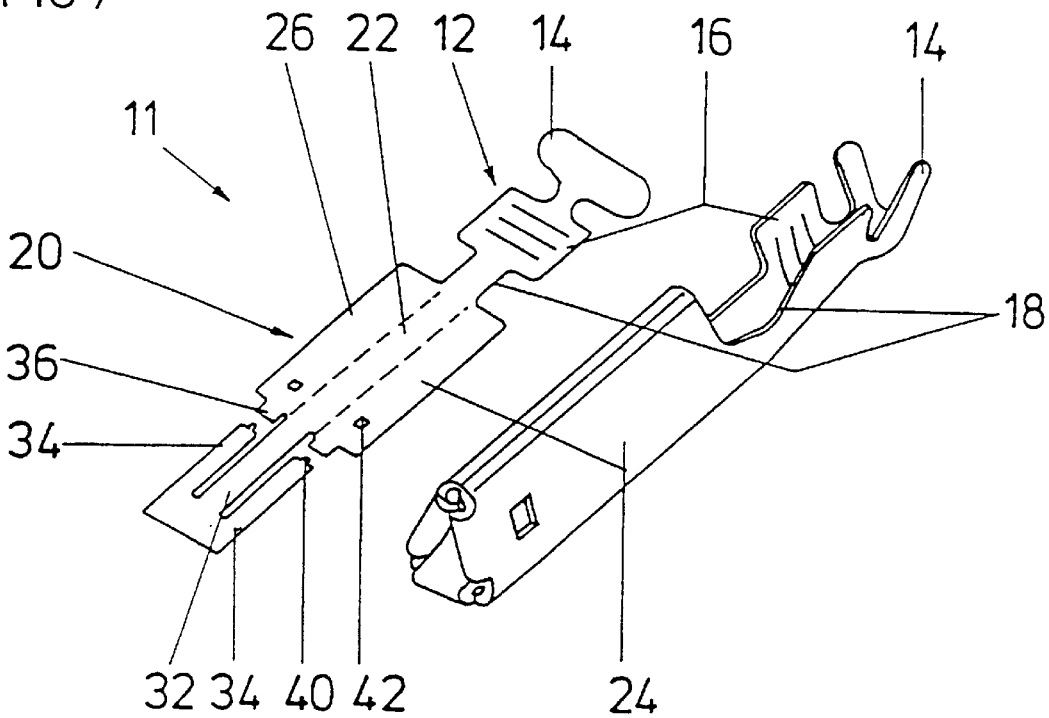
FIG 8
FIG 10
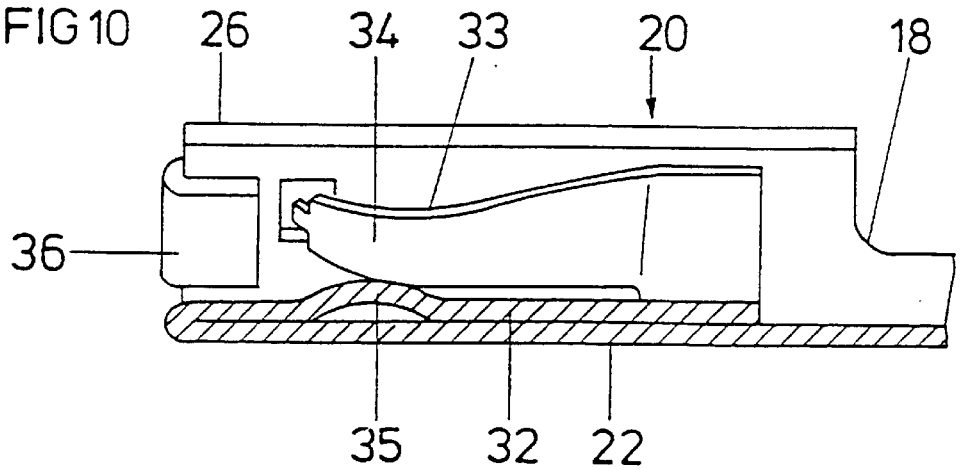
FIG 9
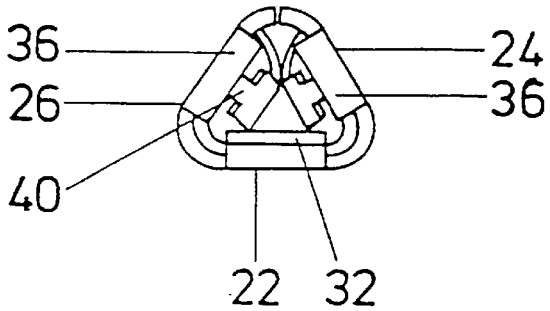
FIG 11
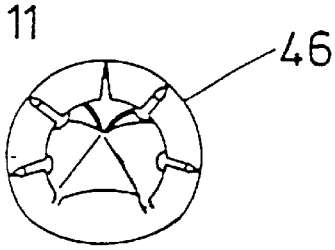

ONE-PIECE CONTACT SPRING

BACKGROUND OF THE INVENTION

1. Field of the Invention

The invention relates to a one-piece contact spring comprising a box-shaped contact part having a top wall, side walls and a bottom wall, from which at least one spring arm is bent back into the interior of the contact part at the insertion opening, which, together with at least one additional spring arm forms a plug-in contact socket.

2. Brief Description of the Prior Art

Contact springs are generally known. They are employed preferably as connectors in automotive engineering in order to establish releasable contact points paying attention to increased contact safety.

Known contact springs usually are of multi-part design in order to thus ensure the afore-mentioned contact safety, especially by combination of different materials. In this regard, there is often provided a box-shaped contact part having resilient contact lugs in its interior which cooperate with the respective counter- or complementary contact.

However, it is also known,that different materials cause increased expenditure as regards the storage thereof. A plurality of separate parts to be joined together for constituting the finished product thus also means an increased assembly expenditure.

EP 0 654 853 B1 reveals a contact spring in the form of a contact spring socket, which has a contact part bent from one piece, with the integrated spring arms thereof being acted upon by additional springs in order to thus ensure the required contact safety. The additional springs are welded to the spring arms and thus are permanently and unreleasably connected thereto. The contact part is a stamped part made from a corresponding sheet metal part and in several bending operations is bent into the final shape, and in the course of this process the additional springs are incorporated which in the assembled state are integrally joined to the spring arms.

Apart from the fact that the design with two parts to be joined during manufacture of the known contact spring results in increased manufacturing expenditure, the influence of welding heat on the spring behavior of the additional spring is disadvantageous.

Furthermore, the constructional design of the known contact spring provides for forwardly opening spring arms formed at the rear end of the contact part. Due to the reduced spring deflection length caused thereby, a reduced spring effect results that can be compensated only by means of the additional spring member.

SUMMARY OF THE INVENTION

On the basis of this prior art, it is the object of the invention to indicate a contact spring of the type indicated at the outset, which can be manufactured with as little expenditure as possible and ensures safe functioning. In particular, a multi-piece design is to be avoided while ensuring sufficient contact safety.

According to the invention, this object is met by the characterizing features of claim 1. Additional advantageous developments are indicated in the dependent claims.

Accordingly, it is provided according to the invention that the spring arm bent back into the interior of the contact part is integrally formed on the narrow side of the bottom wall or a side wall on the face side thereof, that at least two additional spring arms are integrally formed laterally at the free end of the bent-back spring arm and are set on edge at an angle, preferably at right angles, and extend with their free ends towards the insertion opening and constitute receptacle for a complementary contact.

Due to the afore-described design according to the invention, in which the two spring arms are provided adjacent the bent-back free end of a contact spring integrally formed on the bottom wall, the invention realizes a quasi doubled spring deflection length with the same short length of the contact part, which has a favorable effect on the resilience behavior of the spring arms and thus on the contact safety of the contact spring.

Furthermore, for improving the contact forces of the contact spring according to the invention, it is advantageously provided that the spring arms are each provided with curved portions facing each other and thus narrowing the cross-section of insertion for a complementary contact in corresponding manner, so that the latter urges the spring arms apart upon insertion thereof. Due to this deflection from the rest position, with the spring arms being expediently biased in the rest position as well, the resetting force of the spring arms, and thus the contact force thereof, is increased.

Backing-up of the spring force, i.e. of the closing or contact force, of the respective spring arm by provision of an additional spring is not necessary with the contact spring according to the invention, but nevertheless may be provided. However, the constructional conception underlying the invention thus is realized in surprisingly simple manner.

In accordance with an expedient development of the invention, the bottom wall is integrally formed with two side walls set on edge in longitudinal direction and one side wall is integrally formed with the top wall set on edge in longitudinal direction, with each of the walls forming right angles with respect to the adjacent walls and the free edges thereof abutting each other, so that said walls, together with the bottom wall, constitute a closed box profile of rectangular cross-section.

In a further improvement of this design, only two opposing spring arms are provided near the insertion opening with the afore-mentioned curved portions each, which are directed towards the longitudinal central axis and which contact each other and thus establish the contact area for a flat complementary contact. The two opposing spring arms in this case are expediently constituted by the angled additional spring arms formed on the bentback spring arm that is integrally formed on the bottom wall.

According to an alternative embodiment, which is provided in particular for pin-shaped complementary contacts, there are provided three walls only, namely a bottom wall and two side walls. The side walls are set on edge along the bottom wall to such an extent that the free edges thereof abut each other and constitute together with the bottom wall a closed box profile of triangular cross-section. The cross-section may also be chosen to be round on the outside and triangular on the inside.

In this respect, it is provided according to a further development that each side wall and the bottom wall have a spring arm associated therewith, with the curved portions thereof contacting each other and establishing a defined contact area for a pin-shaped complementary contact in this case as well.

Irrespective of whether there is a rectangular or a triangular cross-sectional profile of the contact part, the curved portions of the spring arms, according to a further development of the invention, preferably are disposed with the same spacing from the insertion opening each.

For enhancing the contact force of the spring arms, it is provided that each spring arm has a mechanical support disposed on both sides of the curved portion of the respective spring arm each and cooperating with the side wall associated with this spring arm.

Advantageously, the mechanical support of the spring arm integrally formed on the bottom wall is constituted on the one hand by the bending thereof on the bottom wall and on the other hand by abutment on the bottom wall.

The mechanical support of the additional spring arms formed on the bent-back free end of the contact spring formed on the bottom wall is achieved in that these are each supported in front of and behind the curved portion on the associated side wall.

In a further development, the additional spring arms preferably have a centrally formed projection at their free end facing the insertion opening, which engages in a recess formed in the associated side wall and thus establishes a mechanical support for the contact springs. The respective spring arm, by way of the neck-like projection formed thereon, is guided in the recess in the side walls in terms of its height and lateral dimension, while the shoulder-like lateral abutment areas are supported at the edge of the recess, i.e. on the side wall.

Furthermore, the end of the box-shaped contact part directed away from the insertion opening, in a manner known per se, is provided with a terminating device for a connecting cable, which preferably is in the form of a crimp terminal or an IDC terminal.

Another advantageous development of the contact spring according to the invention consists in that the free longitudinal edges of the side walls of the contact part are connected to each other in positive, i.e. form-fitting, manner so that in addition to the bending resistance of the material of the contact part, a resistance in terms of shape has to be overcome as well for damaging the integrity of the contact part. This is achieved in that the free longitudinal edges of the side walls are provided with lugs which are formed on a free longitudinal edge of one side wall of the contact part and engage in slots formed beside the free longitudinal edge of the corresponding side wall of the contact part.

In this respect, it is possible that the lugs formed on a free longitudinal edge of one side wall of the contact part engage through the slots formed beside the free longitudinal edge of the corresponding side wall and optionally are bent over.

These as well as additional advantageous developments and improvements of the invention are subject matter of the dependent claims.

BRIEF DESCRIPTION OF THE DRAWINGS

The invention, advantageous developments and improvements of the invention as well as specific advantages thereof shall be elucidated and described in more detail by way of an embodiment of the invention shown schematically in the drawings, in which

FIG. 7 shows a preliminary stage for an alternative embodiment of the contact spring according to FIG. 1 with triangular cross-section, after stamping from sheet material;

FIG. 8 shows a perspective view of the finished triangular contact spring according to FIG. 7 after the bending operation, having a contact part and a terminating part;

FIG. 9 shows an end view of the triangular contact spring according to FIG. 8 as seen from the insertion side;

FIG. 10 shows a longitudinal sectional view of the contact part of the contact spring according to FIG. 8; and FIG. 11 shows an end view of a contact spring of circular cross-section as seen from the insertion side.

DETAILED DESCRIPTION OF THE PREFERRED EMBODIMENTS

Figure 1:
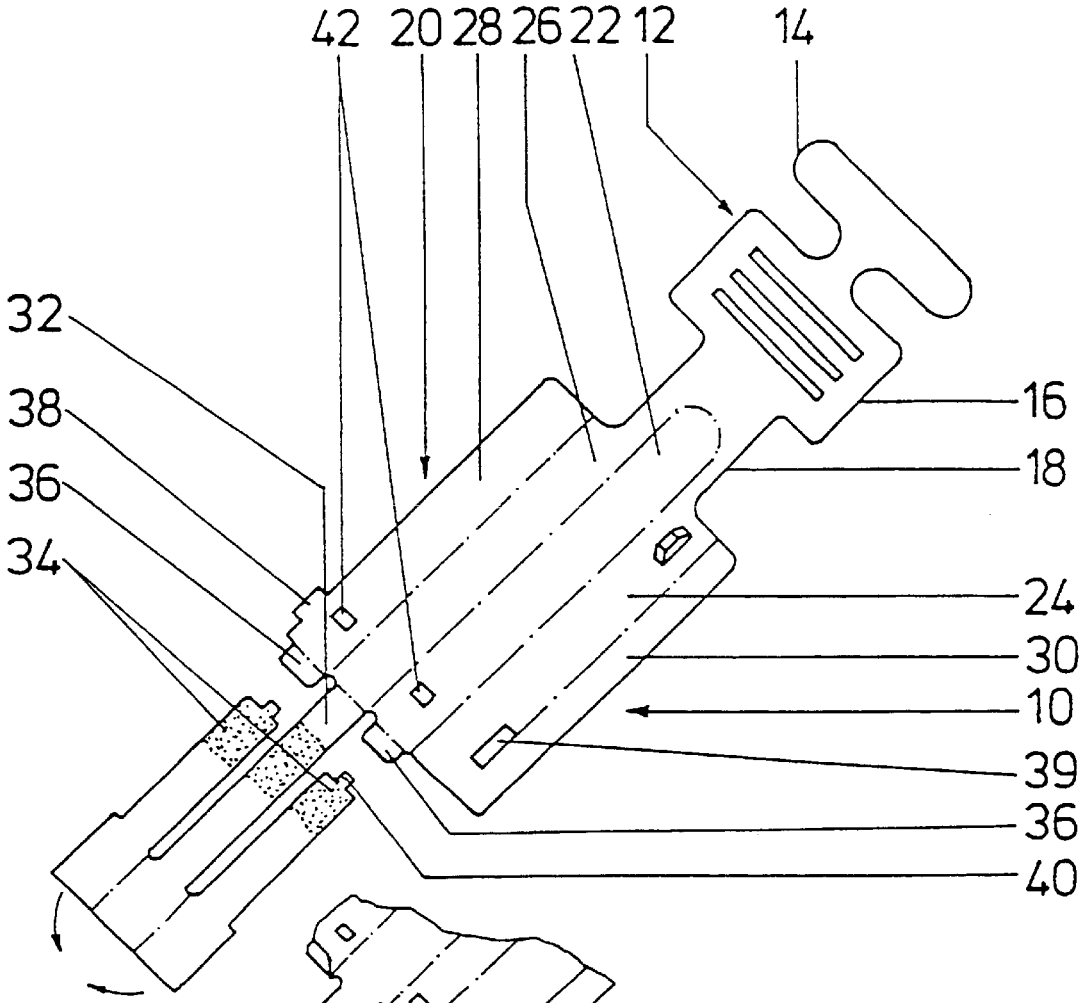
FIG. 1 shows a perspective view of preliminary material for a contact spring according to the invention in an initial state after stamping from sheet material.

FIG. 1 illustrates a perspective view of the preliminary material for a contact spring 10 according to the invention in an initial state after stamping thereof from sheet material. This view shows a terminating part 12 at the rear end, having two insulation claws 14 and two conductor wire claws 16, with the terminating part being connected to a contact part 20 via a connecting web 18.

The contact part 20 following said terminating part 12 is formed of a bottom wall 22, two laterally adjacent side walls 24, 26 and a top wall 28 which, in the view according to FIG. 1, are separated from each other by bending lines shown in broken lines.

Figure 4:
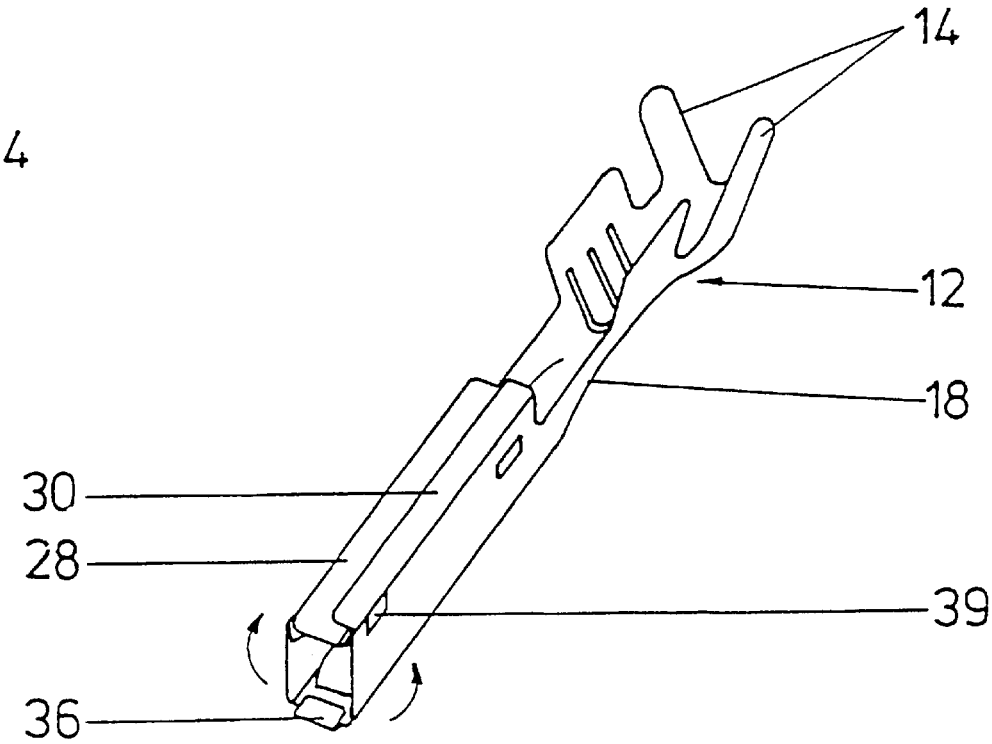
FIG. 4 shows a finished contact spring made from the preliminary material according to FIG. 1 and having a contact part and a terminating part.

While one side wall 26 has the top wall 28 integrally joined thereto, the other side wall 24 has a bending lug 30 formed thereon which, in the assembled state, is bent over and engages over the top wall 28 as shown in FIG. 4.

At the end of the contact part 20 opposite the terminating part 12, the strip joined to the top wall 28 and constituting the side wall 26 is followed by a strip 32 which, at the free end thereof, is integrally formed on both sides thereof with strip-shaped spring arms 34 which, in the assembled state, i.e. in the finished contact spring 10, have the function of establishing contact with a complementary contact, not shown here, with the arrows shown in the drawings indicating the intended bending direction.

The strips constituting the bottom wall 22 and the top wall 28 each have lugs 36 formed on the front side thereof, which in the assembled state, i.e. in the finished state of the contact spring 10 according to FIG. 4, serve as mis-mating preventing means. Finally, near the subsequent insertion side, a lug 38 is formed laterally on the top wall 28, which cooperates with a recess 39 formed in side wall 24 abutting the top wall 28 in the assembled state.

Figure 2:
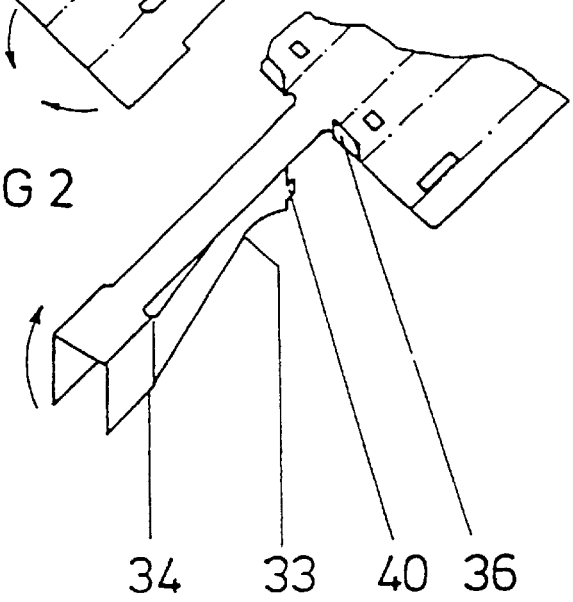
FIG. 2 shows the preliminary material for a contact spring according to FIG. 1 after a first bending operation.

FIG. 2 shows a fragmentary view of the arrangement according to FIG. 1, after a first assembly step in which the spring arms 34 adjoining the free end of the spring arm 32 on the outside thereof are bent by 90° parallel to the longitudinal direction of the spring arms 32, 34. An arrow indicates the bending direction provided for the next bending step (FIG. 3).

Figure 3:
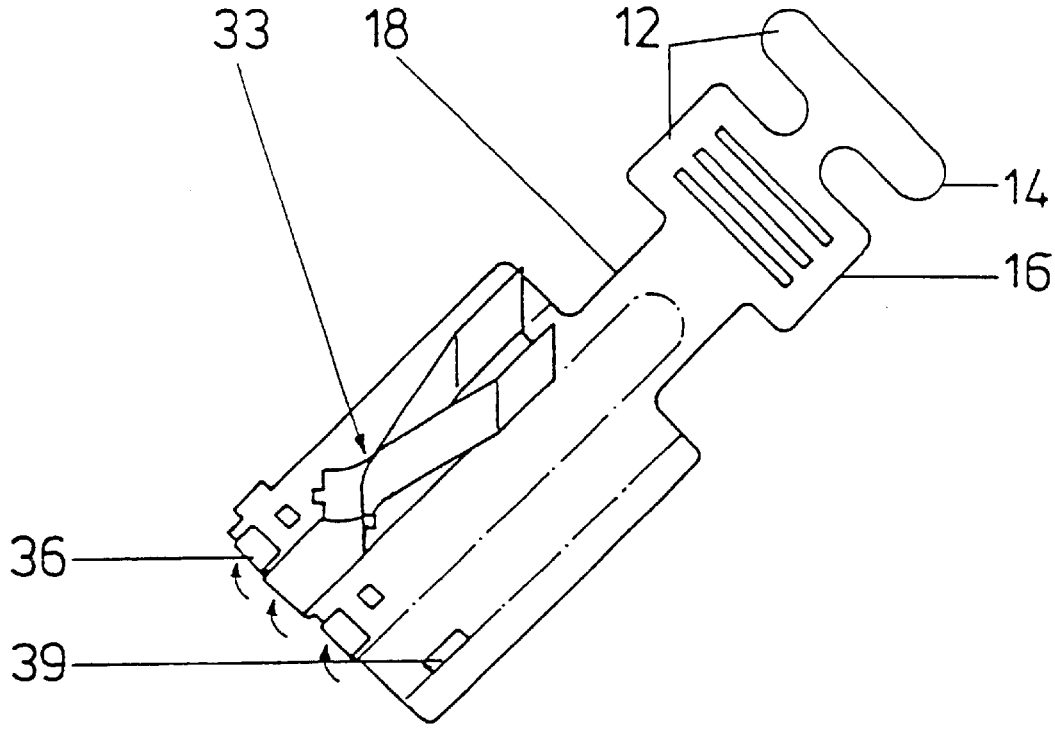
FIG. 3 shows the preliminary material for a contact spring according to FIG. 1 after a second bending operation.

This illustration shows, furthermore, that the mutually opposing spring arms 34 are each provided with a curved portion 33 directed towards each other, i.e. inwardly, so that they contact each other (cf. in particular FIG. 3). This increases the contact force and thus has a favorable effect on the contact safety of the finished contact spring 10.

The free ends of the strips constituting the spring arms 34 are formed on their face side with central noses or projections 40 each which engage in recesses 42 formed in the bottom wall 22 and the top wall 28 each. By means of the projections 40, the respective curved portions 33 are supported, thus ensuring the bias thereof so that the contact force remains as constant as possible.

Moreover, in the assembly state shown in FIG. 2, the lugs 36 serving as mis-mating preventing means are shown in their bent-up state.

FIG. 3 shows the arrangement according to FIG. 1 following the second bending operation. Spring arm 32 is bent back becoming substantially flush against side wall 26, so that the spring arms 32, 34 are shaped with the curved portion 33 as it is in their final position. The lugs 36 serving for mis-mating prevention safety are also bent back in accordance with the arrows shown.

FIG. 4 finally depicts a finished contact spring 10 according to the invention in which the strips constituting the side walls 24, 26 and the top wall 28 as well as the bending lug 30 are bent along the bending lines parallel to the longitudinal axis in accordance with the arrows as shown in FIGS. 1 to 3.

In similar manner, the two insulation claws 14 and the two conductor wire claws 16 are bent up as well. The contact spring 10 thus is ready for use.

Figure 5:
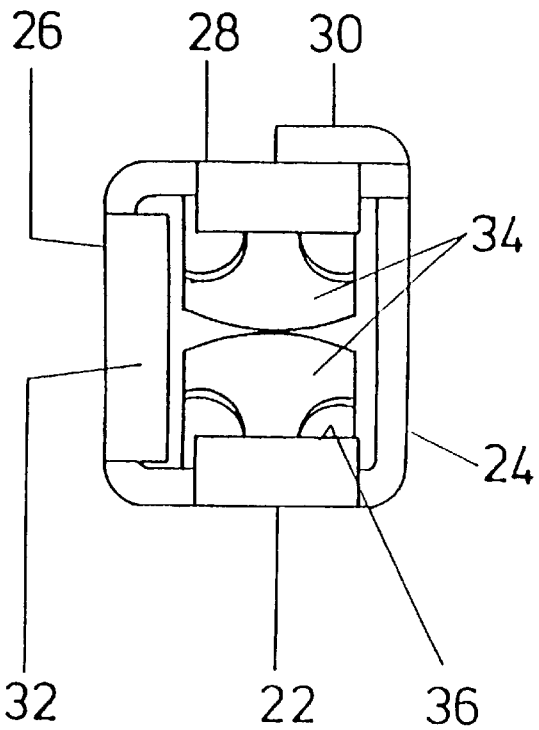
FIG. 5 shows an end view of the contact spring according to FIG. 4 as seen from the insertion side.

FIG. 5 shows an end view of the finished contact spring 10 according to FIG. 4 as seen from the insertion side. The reference numerals each designate the same features of the contact spring 10 as referenced in the previous figures.

Figure 6:
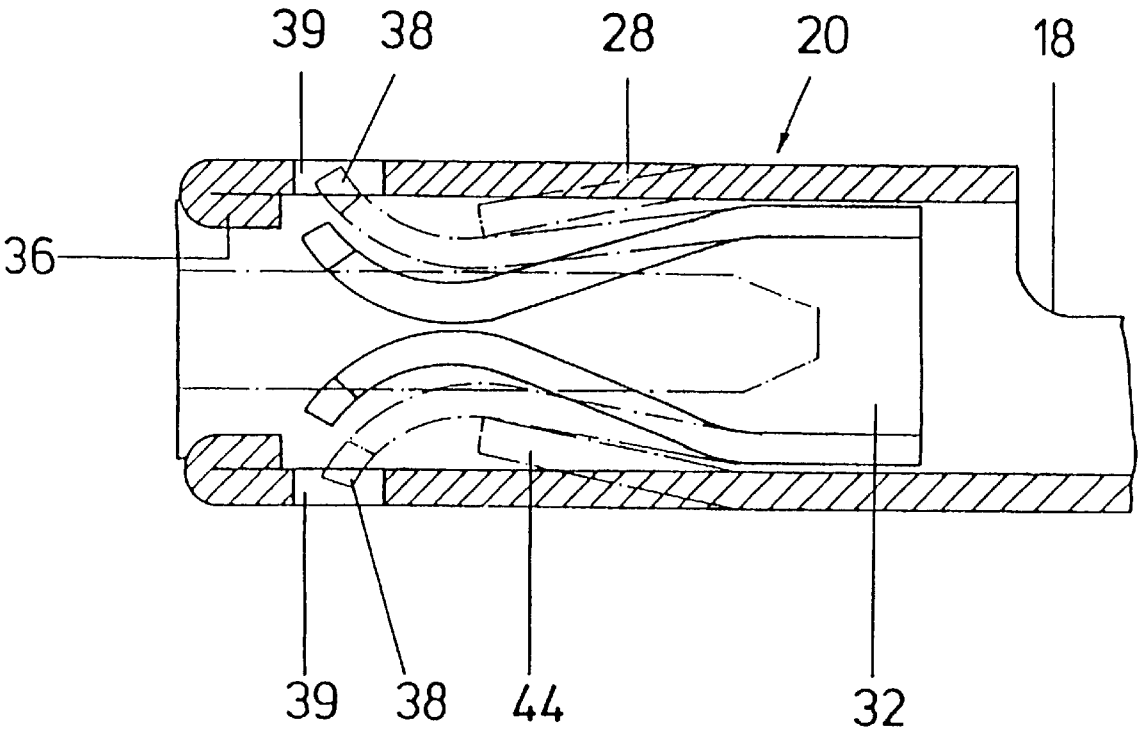
FIG. 6 shows a longitudinal sectional view of the contact part of the contact spring according to FIG. 4.

FIG. 6 shows a longitudinal sectional view of another embodiment of the contact part 20 designed similar to contact spring 10 illustrated in FIGS. 1 to 5, but having in addition pressed-in portions 44 which are provided on the bottom wall 22 and the top wall 28 so as to support the spring arms 34.

FIG. 7 illustrates a perspective view of the preliminary material for an alternative embodiment of a contact spring 11 similar to FIG. 1, which however is of triangular cross-section, after stamping thereof from sheet material. Due to the fact that there is thus one side less necessary, the stamped blank is narrower than the one shown in FIG. 1, however with most of the other features being largely maintained. The corresponding, already elucidated features thus are designated with the same reference numerals.

FIG. 8 shows a perspective view of the finished triangular contact spring 11 according to FIG. 7 after the bending operation, having a terminating part 12 and a contact part 20. Curved portion 33, 35 increases the contact force upon any mating member inserted into the contact spring 11. In addition, located at the front, central portion of spring arms 34 are projections 40 which are inserted into recesses 42 located on the side walls 24 and 26 when the contact spring 11 is in the fully assembled state. The insertion of the projections 40 into the recesses 42 causes a bend in the spring arms 34 such that curved portion 33 is formed. Additionally, a curved portion 35 is formed when spring arm 32 is bent back against bottom wall 22. As can be seen in FIG. 9, three curved portions 33, 35 are then present in the contact spring 11, increasing the contact force against any mating members inserted into contact spring 11.

FIG. 9 shows an end view of the triangular contact spring 11 according to FIG. 8 as seen from the insertion side. It is apparent from this view that this alternative embodiment of the contact spring 11 according to the invention is preferably provided and suitable especially for pin-like complementary contacts, i.e. in particular for slender complementary contacts, such as those having circular cross-section, since the two side walls 24 and 26, and bottom wall 22 and the corresponding spring arms 32, 34 provided with a curved portion 33, 35 each, are applied to the complementary contact in biased manner and fix the same.

FIG. 10 shows a longitudinal sectional view of the contact part 20 of contact spring 11 according to FIG. 8. Various embodiments of the contact spring are displayed in FIGS. 5, 9, and 11. FIG. 5 shows a contact spring 10 having a rectangular cross-section, whereas FIG. 9 displays a contact spring 11 with a triangular cross-section and FIG. 11 displays a contact spring 46 with a circular cross-section. Accordingly, spring arms 34 in contact spring 11 are not parallel but rather are situated at an angle to each other. Therefore, any member inserted into the contact spring 11 will not be compressed between the rounded portions 33 of the spring arm 34 but rather should be forced to the center of the contact spring 11 by the pressure of the rounded portions 33 and 35, as is likely to happen with contact spring 46.

Finally, FIG. 11 shows an end view of an additional alternative design of a contact spring 46 of circular cross-section, as seen from the insertion side. This contact spring 46 differs from the contact springs described so far merely by the circular cross-section. All additional features described hereinbefore are present here as well as in the other contact springs, so that a detailed description thereof can be dispensed with.

What is claimed is:

1. A one-piece contact spring comprising a box-shaped contact part and a spring arm which is bent back into the interior of the contact part at the insertion opening and together with at least two additional spring arms forms a plug-in contact socket, the bent back spring arm being integrally formed on the narrow side of one of the walls on the face side thereof, said at least two additional spring arms being integrally formed laterally at the free end of the bent back spring arm and are set on edge at an angle and extend with their free ends towards the insertion opening and constitute a receptacle for a complementary contact.

2. A one-piece contact spring according to claim 1, comprised of three walls only, namely a bottom wall and two side walls, the side walls are set on edge along the bottom wall at an angle of <90°, the free edges thereof abut each other, and the side walls together with the bottom wall constitute a closed box profile of triangular cross-section at least on the inside.

3. A one-piece contact spring according to claim 2, wherein each side wall and the bottom wall have a spring arm associated therewith and the curved portions thereof contact each other and establish a defined contact area for a pin-shaped complementary contact.

4. A one-piece contact spring according to claims 1, wherein the end of the box-shaped contact part directed away from the insertion opening is provided with a terminating part having a terminating means for a connecting cable.

5. A one-piece contact spring according to claim 4, wherein the terminating means is constituted by a crimp terminal or an IDC terminal.

6. A one-piece contact spring according to 1, wherein the free longitudinal edges of the top wall and the first side wall are connected to each other in form-fit manner.

7. A one-piece contact spring according to claim 6, wherein the free longitudinal edges of the top wall are connected to each other by lugs engaging in slots.

8. A one-piece contact spring according to claim 1, wherein the bottom wall is integrally formed with two side walls set on edge in longitudinal direction, a second side wall is integrally formed with the top wall set on edge in longitudinal direction, each of the walls forms right angles with respect to the adjacent walls, and the free edge of the top wall and the first side wall abut each other and constitute a closed box profile of rectangular cross-section.

9. A one-piece contact spring according to claim 8, wherein the two opposite spring arms have curved portions which are directed towards the longitudinal central axis, contact each other and establish a defined contact area for a flat complementary contact.

10. A one-piece contact spring according to claim 9, wherein the two opposing spring arms are constituted by said two additional spring arms.

11. A one-piece contact spring according to claim 9, wherein the curved portions of the spring arms are disposed with the same spacing from the insertion opening each or in offset manner with respect to the same.

12. A one-piece contact spring according to claim 9, wherein each spring arm has a mechanical support arranged on both sides of the curved portion of the respective spring arm each and cooperating with the side wall associated with this spring arm.

13. A one-piece contact spring according to claim 12, wherein the mechanical support of the spring arm integrally formed on the bottom wall is constituted on the one hand by the bending thereof on the bottom wall and on the other hand by abutment on the bottom wall.

14. A one-piece contact spring according to claim 12, wherein the mechanical support of the additional spring arms is formed in that these are supported each in front of and behind the curved portion on the associated side walls.

15. A one-piece contact spring according to claim 14, wherein the additional spring arms each have a centrally formed nose-like projection at their free end facing the insertion opening, which engages in a recess formed in the associated side wall and thus establishes a mechanical support for the spring arms.

* * * * *

UNITED STATES PATENT AND TRADEMARK OFFICE

CERTIFICATE OF CORRECTION

PATENT NO. : 6,450,843 B1 
DATED : September 17, 2002
INVENTOR(S) : Hans-Jost Heimuller It is certified that error appears in the above-identified patent and that said Letters Patent is hereby corrected as shown below:

Column 6,
Line 54, delete “claims” and insert -- claim --
Line 62, after the words “according to” add -- claim --

Signed and Sealed this

Twenty-eighth Day of January, 2003

JAMES E. ROGAN
*Director of the United States Patent and Trademark Office*